US008291541B2

(12) United States Patent
Delaere et al.

(10) Patent No.: US 8,291,541 B2
(45) Date of Patent: Oct. 23, 2012

(54) BRUSH FOR A SCRUBBING, SWEEPING AND/OR POLISHING MACHINE AND SPRAYING DEVICE FOR THE CLEANING OF SEVERAL SURFACES THAT ARE SEPARATED FROM EACH OTHER BY MEANS OF GROOVES AND/OR JOINTS

(76) Inventors: Marc Delaere, Lochristi (BE); Christiaan De Clerck, Lochristi (BE)

( * ) Notice: Subject to any disclaimer, the term of this patent is extended or adjusted under 35 U.S.C. 154(b) by 810 days.

(21) Appl. No.: 12/227,209

(22) PCT Filed: May 11, 2007

(86) PCT No.: PCT/IB2007/001242

§ 371 (c)(1), (2), (4) Date: Nov. 28, 2008

(87) PCT Pub. No.: WO2007/132335

PCT Pub. Date: Nov. 22, 2007

(65) Prior Publication Data

US 2009/0126131 A1 May 21, 2009

(30) Foreign Application Priority Data

May 11, 2006 (BE) ..... 2006/0266

(51) Int. Cl.
*A46B 9/02* (2006.01)
*A46B 7/08* (2006.01)

(52) U.S. Cl. ..... 15/180; 15/49.1; 15/DIG. 5

(58) Field of Classification Search ..... 15/49.1, 15/105, 159.1, 160, 180, 207.2, 210.1, 244.1, 15/DIG. 5

See application file for complete search history.

(56) References Cited

U.S. PATENT DOCUMENTS 3,343,195 A 9/1967 Menges
4,479,277 A * 10/1984 Gilman et al. ..... 15/111
4,480,351 A * 11/1984 Koffler ..... 15/187
4,998,314 A * 3/1991 Borofsky ..... 15/4

(Continued)

FOREIGN PATENT DOCUMENTS

DE 92 07 301.8 11/1993

(Continued)

*Primary Examiner* — Mark Spisich
*Assistant Examiner* — Michael Jennings
(74) *Attorney, Agent, or Firm* — James Creighton Wary

(57) ABSTRACT

The invention relates, on the one hand, to a brush (1) for a scrubbing, sweeping and/or polishing machine for mechanical cleaning of several surfaces that are separated from each other by means of grooves and/or joints, such as, inter alia, paving stones, tiles, Bangkirai and/or building bricks, wherein the scrubbing, sweeping and/or polishing machine is provided so as to move the brush in a plane that is substantially parallel to the said surfaces that are separated from each other, and a scrubbing, sweeping and/or polishing machine provided with one or more brushes (1), the brush (1) being provided with at least one set of polishing bristles (2) for cleaning or polishing the surfaces; at least one set of joint bristles (3) for cleaning the grooves and/or joints between the surfaces; and the polishing bristles (2) having a length that is shorter than the length of the joint bristles (3). Additionally, the invention relates to a spraying device (10) for spraying several surfaces that are separated from each other by means of grooves and/or joints, such as, inter alia, paving stones, tiles, Bangkirai and/or building bricks, wherein the spraying device (10) comprises two or more spray heads (11), each of which produces a water jet (12).

9 Claims, 2 Drawing Sheets

U.S. PATENT DOCUMENTS

| | | | | |
|---|---|---|---|---|
| 5,321,867 | A * | 6/1994 | Probst | 15/160 |
| 5,584,091 | A * | 12/1996 | Borofsky | 15/115 |
| 5,664,278 | A * | 9/1997 | Reisman | 15/160 |
| 5,903,951 | A | 5/1999 | Ionta et al. | |
| 6,021,540 | A * | 2/2000 | Miller et al. | 15/160 |
| 2003/0074754 | A1 * | 4/2003 | Holden | 15/160 |
| 2005/0060822 | A1 | 3/2005 | Chenvainu et al. | |
| 2006/0029458 | A1 * | 2/2006 | Jones | 401/129 |
| 2006/0248667 | A1 * | 11/2006 | Kraemer | 15/28 |
| 2007/0136970 | A1 * | 6/2007 | Hettes | 15/180 |

FOREIGN PATENT DOCUMENTS

| | | |
|---|---|---|
| DE | 20 2004 012695 | 12/2004 |
| DE | 10351880 | 5/2005 |
| FR | 1337633 | 8/1963 |
| WO | WO 01/56529 | 8/2001 |

* cited by examiner

BRUSH FOR A SCRUBBING, SWEEPING AND/OR POLISHING MACHINE AND SPRAYING DEVICE FOR THE CLEANING OF SEVERAL SURFACES THAT ARE SEPARATED FROM EACH OTHER BY MEANS OF GROOVES AND/OR JOINTS

This application claims the benefit of Belgian Application No. 2006/0266 filed May 11, 2006 and PCT/IB2007/001242 filed May 11, 2007, which are hereby incorporated by reference in their entirety.

The invention relates on the one hand to a brush for a scrubbing, sweeping and/or polishing machine for mechanical cleaning of several surfaces that are separated from each other by means of grooves and/or joints, such as, inter alia, paving stones, tiles, Bangkirai and/or building bricks, and furthermore a scrubbing, sweeping and/or polishing machine for mechanical cleaning of several surfaces that are separated from each other by means of grooves and/or joints, such as, inter alia, paving stones, tiles, Bangkirai and/or building bricks, wherein the scrubbing, sweeping and/or polishing machine is provided so as to move the brush in a plane that is substantially parallel to the said surfaces that are separated from each other.

On the other hand, the invention relates to a spraying device for spraying several surfaces that are separated from each other by means of grooves and/or joints, such as, inter alia, paving stones, tiles, Bangkirai and/or building bricks.

For cleaning several surfaces that are separated from each other by means of grooves and/or joints, such as, inter alia, paving stones, tiles, Bangkirai and/or building bricks, high-pressure cleaning is known. In this case, the paving stones, tiles, Bangkirai and/or building bricks are hosed down by means of a water jet under high pressure (approximately 100 bar). Furthermore, any dirty sand present in the grooves and/or joints is removed from said grooves and/or joints.

However there are various disadvantages associated with high-pressure cleaning, i.e.:

- the grooves and/or joints between the surfaces are not cleaned thoroughly;
- the number of surfaces that are separated from each other by means of grooves and/or joints are often damaged by the high pressure force of the water;
- there is a high water consumption;
- sometimes a large quantity of cleaning product has to be used;
- the water splashes, by which surfaces around the surface to be cleaned, such as, inter alia, walls and/or windows are soiled;
- the high-pressure cleaning is labour-intensive. On average 8 working hours are needed for cleaning a surface of approximately 100 $m^2$ composed of paving stones, tiles, Bangkirai and/or building bricks (including introducing fresh white sand into the grooves and/or joints—if this is necessary—, and including cleaning soiled surfaces in the surrounding area).

It is consequently a first object of the invention to provide a brush according to the preamble of the first claim, wherein the abovementioned disadvantages are overcome.

This first object of the invention is achieved, on the one hand, by providing a brush for a scrubbing, sweeping and/or polishing machine for mechanical cleaning of several surfaces that are separated from each other by means of grooves and/or joints, such as, inter alia, paving stones, tiles, Bangkirai and/or building bricks, wherein the scrubbing, sweeping and/or polishing machine is provided so as to move the brush in a plane that is substantially parallel to the said surfaces that are separated from each other, the brush being provided with

- at least one set of polishing bristles for cleaning or polishing the surfaces;
- at least one set of joint bristles for cleaning the grooves and/or joints between the surfaces;

the polishing bristles having a length that is shorter than the length of the joint bristles.

Providing such a brush gives the following advantages:

- the joints, grooves and/or sides of the paving stones, tiles, Bangkirai and/or building bricks are cleaned additionally;
- the number of surfaces that are separated from each other by means of grooves and/or joints are not damaged;
- there is in-depth cleaning of the grooves and/or joints, through which mosses and young grasses are removed;
- there is low water consumption;
- there is a limited use of cleaning products;
- there is no water splashing, by which surfaces around the surface to be cleaned, such as partitions, walls and/or windows are not soiled;
- when the brush is fitted on the scrubbing, sweeping and/or polishing machine, this machine is very easy to handle because of the presence of longer bristles, and additional pressure can be exerted upon these longer bristles, which give additional cleaning;
- the length of time taken to clean is much lower, i.e. approximately one and a half hours (including the introduction of fresh white sand into the grooves and/or joints—if this is necessary—and including cleaning soiled surfaces in the surrounding area);
- any mosses and oils present are also removed, thus improving the external appearance of the surface and improving safety, for example reducing the risk of slipping.

In a preferred embodiment of a brush according to the invention, the joint bristles have a lower density than the polishing bristles.

In an advantageous embodiment of a brush according to the invention, the diameter of the joint bristles is greater than the diameter of the polishing bristles.

In a preferred embodiment of a brush according to the invention, the polishing bristles and the joint bristles are made of plastic.

In an advantageous embodiment of a brush according to the invention, the polishing bristles and/or joint bristles are reinforced with a reinforcing material in the core of the bristle.

More preferably, the polishing bristles and/or joint bristles are herewith reinforced by means of iron wire in the core of the bristle.

In a preferred embodiment of a brush according to the invention, the joint bristles extend between the polishing bristles in a cross shape, having on the end of each leg of the cross shape a second leg perpendicular to said first leg, and the polishing bristles extend over substantially all of the remaining surface of the brush.

Such a configuration of the joint bristles and polishing bristles gives the most efficient cleaning of the grooves and/or joints of the surfaces that are separated from each other.

A preferred brush according to the invention is round in shape.

More preferably, the brush herewith has a diameter of approximately 41 cm, the joint bristles have a length of approximately 12 cm, and the polishing bristles have a length of approximately 10 cm.

On the other hand, the first object of the invention is achieved by providing a scrubbing, sweeping and/or polishing machine for mechanical cleaning of several surfaces that are separated from each other by means of grooves and/or joints, such as, inter alia, paving stones, tiles, Bangkirai and/or building bricks, wherein the scrubbing, sweeping and/or polishing machine is provided with one or more brushes that are moved in a plane that is substantially parallel to the said surfaces that are separated from each other, the scrubbing, sweeping and/or polishing machine being provided with one or more brushes according to the invention.

After the surfaces that are separated from each other by means of grooves and/or joints, such as, inter alia, paving stones, tiles, Bangkirai and/or building bricks, have been processed with a scrubbing, sweeping and/or polishing machine, all loosened dirt has to be sprayed off the cleaned surface.

Until now it has been possible to do this with a garden hose connected to the water mains.

However, this method of removing the loosened dirt and/or moss is very labour-intensive, since only a small surface area can be cleaned with the spraying surface of the garden hose.

There are also connectors for connecting to a garden hose with a larger spraying surface. However, the disadvantage of these connectors is that the water is atomized, by which the water flowing out of the connector is under insufficient pressure to remove the loosened dirt and/or moss from the cleaned surface.

A second object of the invention is consequently to provide a spraying device according to the preamble of the eleventh claim, wherein a sufficiently large surface area can be cleared of dirt in one go, while at the same time there is sufficiently great pressure on the water flowing out of the spraying device.

This second object of the invention is achieved by providing a spraying device for spraying several surfaces that are separated from each other by means of grooves and/or joints, such as, inter alia, paving stones, tiles, Bangkirai and/or building bricks, wherein the spraying device comprises two or more spray heads, each of which produces a water jet.

A sufficiently large spraying surface area and sufficiently great pressure of the water flowing out of the spraying device are obtained in this way, with the result that the loosened dirt and/or moss, also including the sand, can be removed from the cleaned surface effectively and in a less labour-intensive manner.

In a preferred spraying device according to the invention, the said water jets have a pressure between 2.8 and 15 bar.

In an advantageous embodiment of a spraying device according to the invention, the two or more spray heads are mounted on a substantially horizontal bearing tube, which is connected to a substantially vertical tube connected to a water supply, by which water from the water supply is guided through the horizontal bearing tube to the spray heads.

More preferably, the substantially vertical tube is supported by a supporting wheel.

In a preferred embodiment of a spraying device according to the invention, the horizontal bearing tube has a length of approximately 50 cm and is provided with 4 spray heads.

In order to explain the features of this invention further and to indicate additional advantages and details thereof, a more detailed description of a preferred embodiment of a brush and a spraying device according to the invention will now follow. It may be obvious that nothing of the following description may be interpreted as being a limitation of the protection of the brush and the spraying device according to the invention demanded for in the claims.

Furthermore, some of these embodiments will be discussed in the figures herewith attached, reference being made to these figures by means of reference numbers, where:

DETAILED DESCRIPTION OF THE PREFERRED EMBODIMENTS

Figure 1:
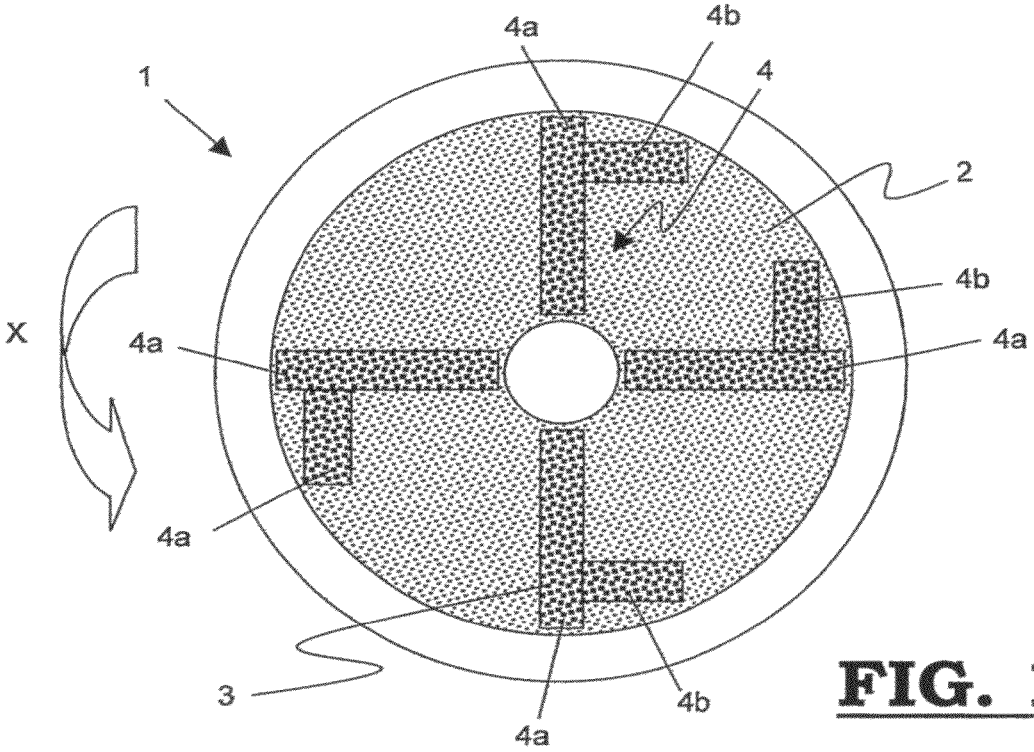
FIG. 1 shows a top view of a preferred embodiment of a brush for a scrubbing, sweeping and/or polishing machine according to the invention.
Figure 2:
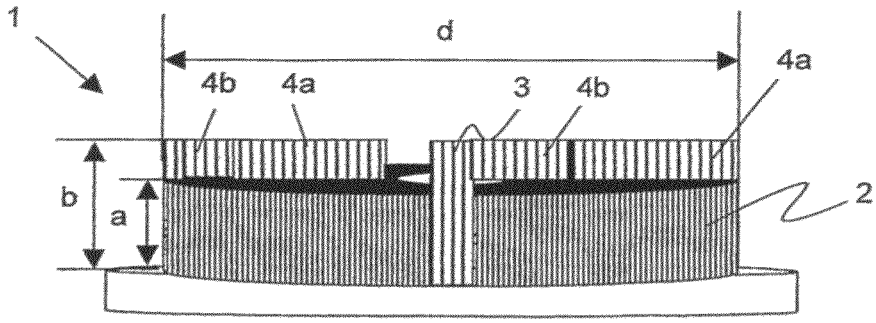
FIG. 2 shows a front view of the preferred brush as shown in FIG. 1.
Figure 3:
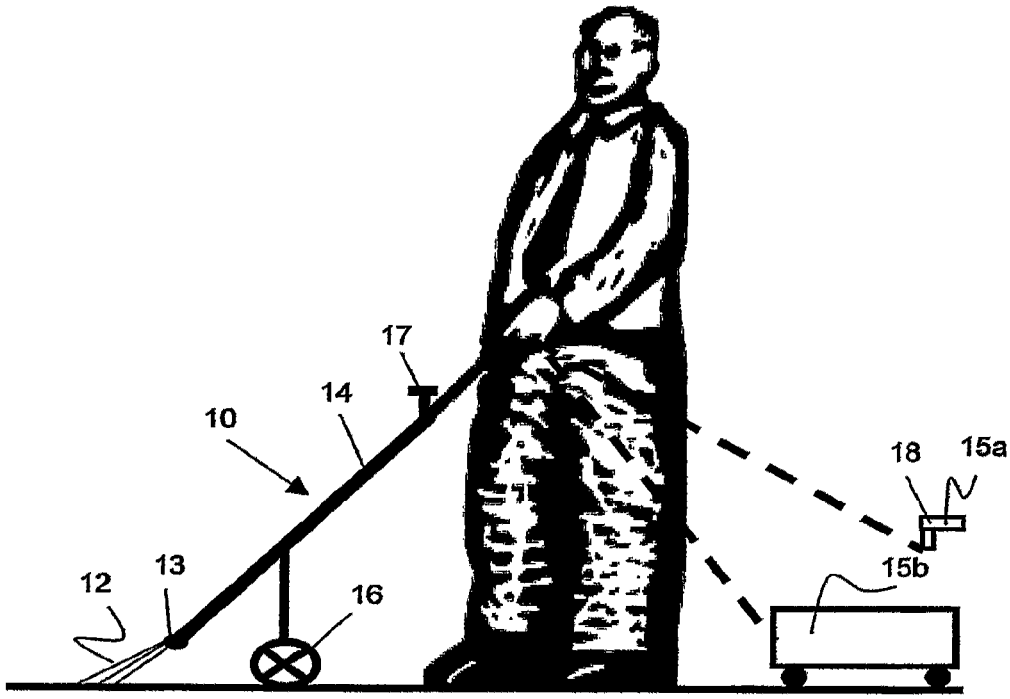
FIG. 3 shows a preferred spraying device according to the invention, which is being operated by a person, and which is connected either to the water mains or to a water tank under pressure.

A brush (1) according to the invention which is provided for a scrubbing, sweeping and/or polishing machine for mechanical cleaning of several surfaces that are separated from each other by means of grooves and/or joints, such as, inter alia, paving stones, tiles, Bangkirai and/or building bricks, wherein the scrubbing, sweeping and/or polishing machine is provided so as to move the brush (1) in a plane that is substantially parallel to the said surfaces that are separated from each other, and as shown in FIGS. 1 and 2, is provided with

- at least one set of polishing bristles (2) for cleaning or polishing the surfaces;
- at least one set of joint bristles (3) for cleaning the grooves and/or joints between the surfaces;

the polishing bristles (2) having a length that is shorter than the length of the joint bristles (3).

The joint bristles (3) preferably have a lower density and a greater diameter than the polishing bristles (2).

The polishing bristles and joint bristles (2, 3) are preferably made of plastic, more preferably of nylon and/or polyester.

Furthermore, the polishing bristles and/or joint bristles (2, 3) can be reinforced with a reinforcement material, preferably iron, in the core of the bristle.

In the preferred brush (1) according to the invention, as shown in FIGS. 1 and 2, the brush (1) is of a round shape and preferably has a diameter (d) of approximately 41 cm.

The composition of the brush (1) in this case is as follows:

- the long, broad joint bristles (3) are made of nylon or of polyester fibre. Said joint bristles (3) have a length (b) of approximately 12 cm, and have a diameter of approximately 3 mm. Said joint bristles (3) ensure that dirt and/for moss is removed from between the grooves and/or joints, and they also clean the sides of the number of surfaces that are separated from each other by means of grooves and/or joints;
- the shorter polishing bristles (2) are made of nylon or polyester fibre. Said polishing bristles (2) have a length (a) of approximately 10 cm, and have a diameter of approximately 2 mm. These shorter bristles give a good scouring and scrubbing effect on the surfaces on which there is dirt and/or moss.

In the preferred embodiment of a brush (1) according to the invention, as shown in FIGS. 1 and 2, the joint bristles (3) extend in a cross shape (4), having on the end of each leg (4*a*) of the cross shape (4) a second leg (4*b*) perpendicular to said first leg (4*a*), and the polishing bristles (2) extend over substantially all of the remaining surface of the brush (1). However, the polishing bristles and joint bristles (2, 3) can also be disposed in a different configuration.

A scrubbing, sweeping and/for polishing machine can be provided with one or more of such above mentioned brushes (1) according to the invention. For cleaning building bricks of a wall there is a machine available that can treat such vertical surfaces.

A spraying device (10) according to the invention for spraying several surfaces that are separated from each other by means of grooves and/or joints, such as, inter alia, paving stones, tiles, Bangkirai and/or building bricks, as shown in FIGS. 3 to 6, comprises two or more spray heads (11), each of which produces a water jet (12). The abovementioned water jets (12) preferably have a pressure between 2.8 and 15 bar.

In the preferred embodiment of the spraying device (10) according to the invention, as shown in FIGS. 3 to 6, the two or more spray heads (11) are mounted on a substantially horizontal bearing tube (13), which is connected to a substantially vertical tube (14), which is connected to a water supply (15*a*, 15*b*), and through which water from the water supply (15*a*, 15*b*) is guided to the spray heads (11) by way of the horizontal bearing tube (13). The water supply can, on the one hand, be from the water mains (15*a*), wherein case the spraying device (10) is connected by means of a tap (18) to the water mains (15*a*). On the other hand, the water supply can be a water tank (15*b*) which is under pressure, preferably with a pressure of 100 bar.

The substantially vertical tube (14) is preferably supported by a supporting wheel (16), and is furthermore preferably provided with a regulating valve (17).

Figure 4:
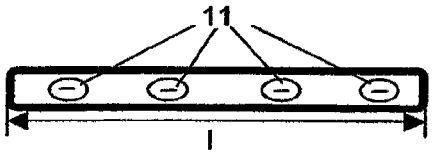
FIG. 4 shows a front view of the horizontal tube provided with 4 spray heads of the preferred spraying device as shown in FIG. 3.
Figure 6:
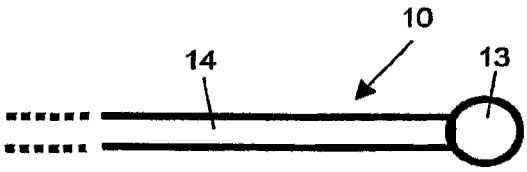
FIG. 6 shows a side view of the preferred spraying device as shown in FIG. 3.
Figure 5:
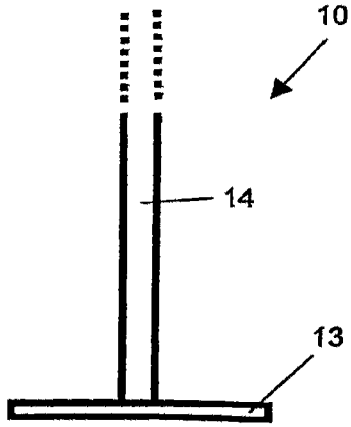
FIG. 5 shows a top view of the preferred spraying device as shown in FIG. 3.

In the preferred spraying device (10) according to the invention, as shown in FIGS. 3 to 6, the horizontal bearing tube (13) has a length (l) of approximately 50 cm and is provided with 4 spray heads (11) (see FIG. 4).

The working procedure for cleaning either a horizontal or a vertical surface consisting of several surfaces that are separated from each other by means of grooves and/or joints, such as, inter alia, paving stones, tiles, Bangkirai and/or building bricks is as follows:

- unloading the machine, brushes, garden hose and the other requisites;
- wetting the surface with a garden hose;
- placing the above mentioned brush(es) (1) on the machine, and starting up the machine;
- setting the brush(es) (1) in rotation (direction of rotation X—see FIG. 1) and pushing the machine over the surface to be cleaned, by which
  - the upper surface of the paving stones, tiles, Bangkirai and/or building bricks is cleaned;
  - the side surface of the paving stones, tiles, Bangkirai and/or building bricks is cleaned;
  - the grooves and/or joints situated between the paving stones, tiles, Bangkirai and/or building bricks are cleaned;
- the above at a constant speed of approximately 0.44 s/m$^2$. Very dirty places are given additional attention by the easy-to-handle brush(es) (1) according to the invention, i.e. more or less pressure can be exerted upon the brush(es) (1);
- rinsing off the cleaned surface with the spraying device according to the invention;
- in the case of paving stones refilling the joints with white sand. This can be performed using the same scrubbing, sweeping and/or polishing machine, but with a brush that is provided with soft and even bristles having a length of approximately 4.5 cm. Through the use of such a brush the white sand is pushed into the joints. This white sand also polishes the paving stones additionally, by which said paving stones acquire an even nicer appearance;
- loading up the machine, brush(es) (1), garden hose and other requisites used.

The invention claimed is:

1. Brush (1) for a scrubbing, sweeping and/or polishing machine for mechanical cleaning of several surfaces that are separated from each other by means of grooves and/or joints, such as, inter alia, paving stones, tiles, Bangkirai and/or building bricks, wherein the scrubbing, sweeping and/or polishing machine is provided so as to move the brush in a plane that is substantially parallel to the said surfaces that are separated from each other, wherein the brush (1) is provided with at least one set of polishing bristles (2) for cleaning or polishing the surfaces;

at least one set of joint bristles (3) for cleaning the grooves and/or joints between the surfaces; the polishing bristles (2) having a length (a) that is shorter than the length (b) of the joint bristles (3), wherein the joint bristles (3) extend between the polishing bristles (2) in a cross shape (4), having on the end of each leg (4*a*) of the cross shape (4) a second leg (4*b*) perpendicular to said first leg (4*a*), and the polishing bristles (2) extend over substantially all of the remaining surface of the brush (1).

2. Brush according to claim 1, wherein the joint bristles (3) have a lower density than the polishing bristles (2).

3. Brush according to claim 1 wherein the diameter of the joint bristles (3) is greater than the diameter of the polishing bristles (2).

4. Brush according to claim 1, wherein the polishing bristles and joint bristles (2, 3) are made of plastic.

5. Brush according to claim 1, wherein the polishing bristles and/or joint bristles (2, 3) are reinforced with a reinforcing material in the core of the bristle.

6. Brush according to claim 5, wherein the polishing bristles and/or joint bristles (2, 3) are reinforced by means of iron wire in the core of the bristle.

7. Brush according to claim 1, wherein the brush (1) is round in shape.

8. Brush according to claim 7, wherein the brush (1) has a diameter (d) of approximately 41 cm, the joint bristles (3) have a length (b) of approximately 12 cm, and the polishing bristles (2) have a length (a) of approximately 10 cm.

9. Scrubbing, sweeping and/or polishing machine for mechanical cleaning of several surfaces that are separated from each other by means of grooves and/or joints, such as, inter alia, paving stones, tiles, Bangkirai and/or building bricks, wherein the scrubbing, sweeping and/or polishing machine is provided with one or more brushes that are moved in a plane that is substantially parallel to the said surfaces that are separated from each other, wherein the scrubbing, sweeping and/or polishing machine is provided with one or more brushes (1) according to claim 1.

* * * * *